United States Patent [19]

Rouanes

[11] 4,445,492

[45] May 1, 1984

[54] IGNITION SYSTEM FOR INTERNAL-COMBUSTION ENGINES

[75] Inventor: Phillipe Rouanes, Parempuyre, France

[73] Assignee: Siemens Aktiengesellschaft, Berlin and Munich, Fed. Rep. of Germany

[21] Appl. No.: 400,467

[22] Filed: Jul. 21, 1982

[30] Foreign Application Priority Data

Jul. 22, 1981 [FR] France ..... 81 14259

[51] Int. Cl.[3] ..... F02P 3/02; F02P 3/04; F02P 1/00

[52] U.S. Cl. ..... 123/606; 123/146.5 A; 123/607

[58] Field of Search ..... 123/606, 607, 598, 621, 123/640, 650, 146.5 A

[56] References Cited

U.S. PATENT DOCUMENTS 3,945,362 3/1976 Neuman et al. ..... 123/606

4,122,815 10/1978 Gerry ..... 123/606

4,168,692 9/1979 Gerry ..... 123/606

*Primary Examiner*—Raymond A. Nelli

*Attorney, Agent, or Firm*—Herbert L. Lerner; Laurence A. Greenberg

[57] ABSTRACT

Ignition system for internal combustion engines, including a transformer having a primary side with a primary winding and a secondary side with at least one secondary winding, a chopper connected to the primary winding for addressing the primary winding, a d-c or rectified a-c voltage source connected to the chopper, the at least one secondary winding being selectively coupled to spark plugs of the internal combustion engine, and electronic control means connected to the chopper for driving the chopper with pulse sequences having individual width-modulated pulses and for supplying the spark plugs with igintion pulse sequences having corresponding individual ignition pulses with modulated energy.

10 Claims, 8 Drawing Figures

IGNITION SYSTEM FOR INTERNAL-COMBUSTION ENGINES

This invention relates to an ignition system for internal-combustion engines, especially gasoline engines in motor vehicles, having a transformer, the primary winding of which is supplied by a chopper which is fed from a d-c or rectified a-c source and is connected into an electronic control circuit, and which can be selectively coupled on the secondary side to the spark plugs through at least one secondary winding.

In the construction of ignition systems for internal-combustion engines, it is increasingly more important for the ignition system to ensure a good combustion of the fuel mixture, particularly in the range of low engine speeds and lean fuel mix composition, since only in this way is a good energy utilization and minimum air pollution achieved.

In the conventional ignition systems, in which the high voltage is generated by ignition coils and/or by capacitive devices, these requirements are not met sufficiently.

Co-pending U.S. patent application Ser. No. 236,522 therefore proposes an ignition system for gasoline engines, which generates a high voltage at the spark plugs and which allows the duration of the ignition spark to be adjusted to be sufficiently long, especially in the range of low engine speeds.

In this ignition system, a transformer is assigned to each spark plug, the primary winding of which is connected to an electronic control circuit. The secondary windings, which can be shorted by a mechanical or electronic switch, are in metallic connection with the electrodes of the spark plugs. The transformers are supplied by a chopper fed from a d-c or rectified a-c voltage source. One transformer is additionally provided on the secondary side with an auxiliary winding which delivers signals to the electronic control circuit and thereby influences the frequency and/or the pulse duration of the chopper.

For this purpose, the aforementioned co-pending U.S. application provides a transformer which is, in particular, also simplified as to the amount of material required, with a primary and secondary coil disposed on a common magnetic core. The core of the transformer is constructed in such a manner that several secondary coils are associated with one primary coil.

Finally, the aforementioned co-pending U.S. application likewise proposes an improved ignition system for internal-combustion engines which can be used in conjunction with the mechanical ignition distributors that are customary in the production of motor vehicles. In such a device, the spark plugs are connected through the distributor rotor of an ignition distributor and through its contacts, to the secondary winding of a transformer which is inductively coupled to an auxiliary winding that can be short-circuited or opened by a sensor-controlled mechanical, electromechanical or electronic switch. The sensors are disposed at a suitable point in the internal-combustion engine, for instance at the shaft of the distributor rotor, at the cam shaft, or at the crank shaft.

It is accordingly an object of the invention to provide an ignition system for internal-combustion engines, which overcomes the hereinafore-mentioned disadvantages of the heretofore-known devices of this general type, and which provides internal-combustion engines which extremely advantageous data as to fuel consumption and environment pollution, and specifically also with lean fuel mixtures, and with a basically large volumetric piston displacement, high compression, large electrode spacing and heavy fouling of the spark plugs.

With the foregoing and other objects in view there is provided, in accordance with the invention, an ignition system for internal combustion engines, especially gasoline engines in motor vehicles, comprising a transformer having a primary side with a primary winding and a secondary side with at least one secondary winding, a chopper connected to said primary winding for addressing said primary winding, a d-c or rectified a-c voltage source connected to said chopper, said at least one secondary winding being selectively coupled to spark plugs of the internal combustion engine, and electronic control means connected to said chopper for driving said chopper with pulse sequences having individual width-modulated pulses and for supplying the spark plugs with ignition pulse sequences having corresponding individual ignition pulses with modulated energy.

In accordance with another feature of the invention, the individual pulses of the pulse sequences driving the chopper include at least one initial individual pulse having a relatively longer duration and remaining pulses having a relatively shorter duration, for giving the corresponding individual ignition pulses sufficient energy to ignite a fuel and air mixture under even the worst conditions.

In accordance with a further feature of the invention, the duration of the at least one initial individual pulse of the pulse sequences fed to the chopper is modulated, for causing the corresponding individual ignition pulse to ignite the fuel and air mixture under even the worst conditions.

If the fuel/air mixture is ignited by a suitable high-energy individual firing pulse, then ignition pulses per ignition pulse sequence of lower energy are sufficient to maintain the combustion of the mixture. It is therefore proposed advantageously that the duration of the individual pulses of each pulse sequence and thereby, the energy of the individual pulses drops to a value which is lower than in the first individual pulses and is preferably constant but is sufficient to ensure the further combustion. Thus, in accordance with a further feature of the invention, the duration of the individual pulses of each of the pulse sequences decreases toward a constant value in the sequence.

The pulse sequences with modulated individual pulses are generated, for instance, in an electronic control circuit which precedes the chopper and is triggered by a sensor-controlled pickup disposed at a suitable point in the engine such as an OT(upper dead center) pickup. Therefore, in accordance with yet another feature of the invention, the electronic control means are in the form of an electronic control circuit connected to the chopper for generating and modulating the pulse sequence fed to the chopper.

In accordance with yet a further feature of the invention, the chopper includes a transistor having a base being connected to the electronic control means and an emitter and a collector defining an emitter-collector path connected in series with the primary winding, the series connection of the primary winding and emitter-collector path of the transistor being connected to the voltage source.

In accordance with yet an added feature of the invention, the at least one secondary winding includes a separate secondary winding respectively coupled to each spark plug, an auxiliary winding being respectively inducaively coupled to each of the secondary windings and being wound in the opposite sense relative to the secondary windings, the chopper being driven with constant pulse sequences having individual pulses with modulated duration, and a circuit having mechanical, electromechanical or electronic switch means connected to the auxiliary windings for short circuiting and opening the circuit in a firing sequence rhythm.

In accordance with yet an additional feature of the invention, the at least one secondary winding includes a separate secondary winding respectively connected in series with each two spark plugs, an auxiliary winding being respectively inductively coupled to each of the secondary windings and being wound in the opposite sense relative to the secondary windings, the chopper being driven with constant pulse sequences having individual pulses with modulated duration, and a circuit having mechanical, electromechanical or electronic switch means connected to the auxiliary windings for short circuiting and opening the circuit in a firing sequence rhythm.

In accordance with still another feature of the invention, the at least one secondary winding is in the form of a single secondary winding, and including an auxiliary winding being inductively coupled to the secondary winding and being wound in the opposite sense relative to the secondary winding, an openable circuit connected to the auxiliary winding, the chopper being controlled by constant pulse sequences having individual pulses with modulated duration, and a mechanical or electronic distributor connecting the secondary winding to the spark plugs in a firing sequence rhythm with the circuit open.

In accordance with a concomitant feature of the invention, the electronic control means includes a monostable multivibrator stage, and the at least one secondary winding is in the form of a single secondary winding, and including a mechanical or electronic distributor connecting the secondary winding to the spark plugs in a firing sequence rhythm, the chopper being supplied with pulse sequences having modulated individual pulses with a duration being determined by the monostable multivibrator stage.

Other features which are considered as characteristic for the invention are set forth in the appended claims.

Although the invention is illustrated and described herein as embodied in ignition system for internal-combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 1:
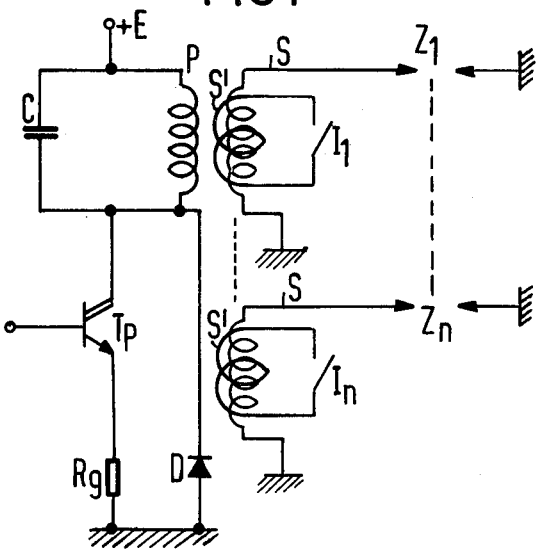
FIG. 1 is a schematic circuit diagram of an ignition system operated in accordance with the invention.

Referring now to the figures of the drawing and first particularly to FIG. 1 thereof, there is seen an ignition system having a tuned L-C circuit including a capacitor C and the primary winding P of a transformer, a transistor $T_p$ acting as a chopper or switch, and a resistor $R_9$. The tuned circuit, transformer and resistor are connected in series and are connected to a d-c voltage source +E. A diode D is connected in parallel with the series circuit of the transistor $T_p$ and the resistor $R_9$. At the base thereof, the transistor $T_p$ is connected into an electronic control circuit constructed as a free-running modulator, such as is shown, for instance, in FIG. 8.

On the secondary side, the transformer has a secondary winding S for each spark plug $Z_1$ to $Z_n$ which is inductively coupled to an auxiliary winding S' wound with the opposite sense. The auxiliary windings S' can be opened and short-circuited, for instance, by sensor-controlled mechanical, electromechanical or electronic switches $I_1$ to $I_n$ in the rhythm of the ignition pulse times. With the auxiliary winding shorted, the high voltage on the secondary side of the high-voltage winding disappears or its intensity is reduced so that no spark is formed at the spark plugs. The sensors themselves are disposed, for instance, at the shaft of the distributor rotor.

Figure 8:
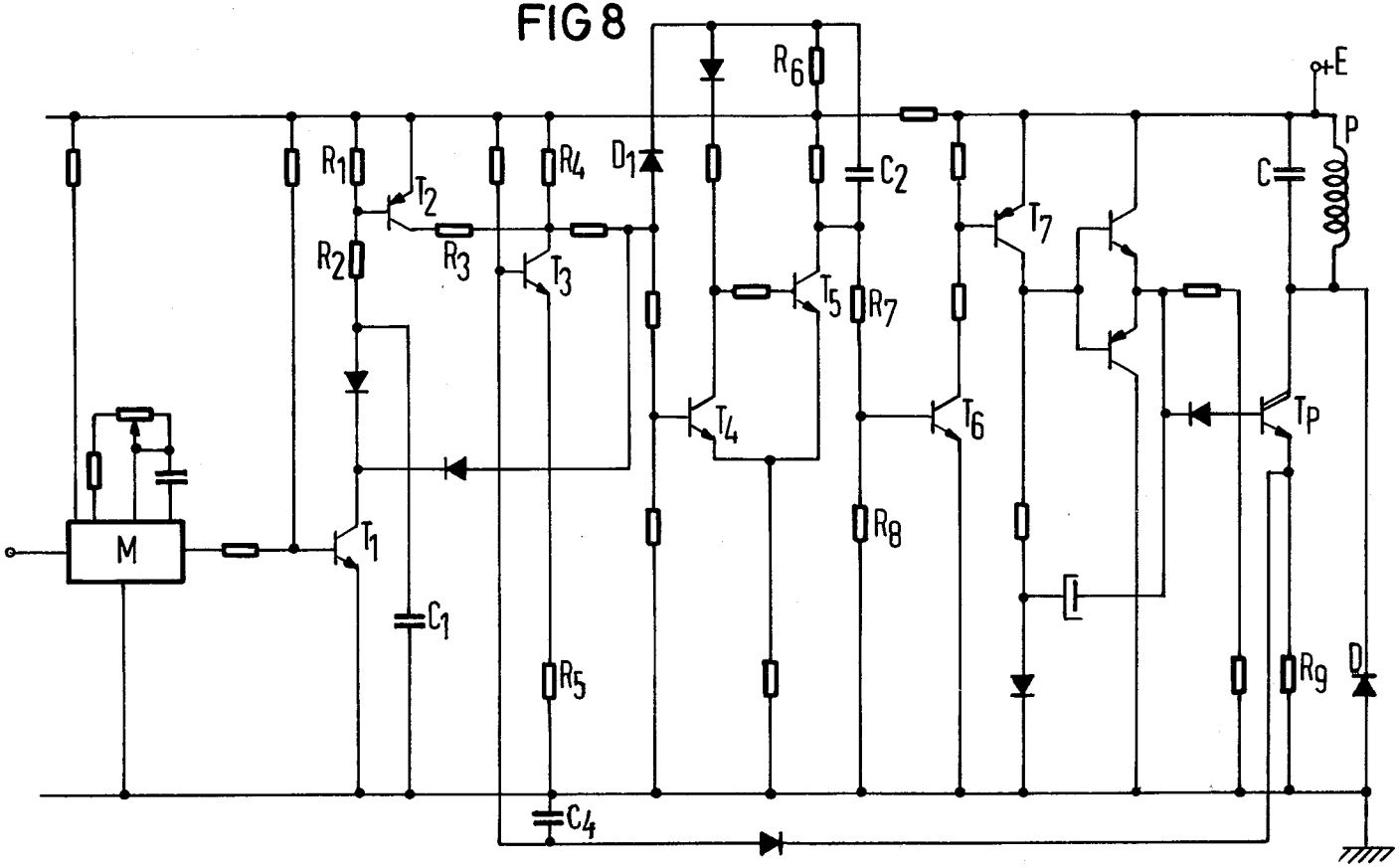
FIG. 8 is a circuit diagram of an embodiment of an electronic control circuit according to the invention, with a chopper.

The operation of this ignition system is as follows:

A pulse sequence triggered with a spacing in time $A_p$ (see FIG. 2) by a non-illustrated transmitter, such as a motor-speed-controlled transmitter, an OT transmitter or a sensor coupled to the engine starter fly wheel, and modulated by the electronic control circuit according to FIG. 8, addresses the base of the transistor $T_p$ during the time $C_p$. The point "O", i.e., the point in time at which every individual pulse sequence sets in, takes into consideration various engine parmeters, such as the upper dead-center instant, or data determined by temperature sensors.

The duration $\Delta t_1$, $\Delta t_2$ and $\Delta t_3$ of the first individual pulse of each pulse train is chosen to be longer than the duration $\Delta t_4$ of the remaining individual pulses of the pulse train, with the pulse duration of the first individual pulses decreasing as seen in the pulse sequence direction. Due to the pulse sequence according to FIG. 2, a collector current $I_c$ with the waveform shown in FIG. 3 flows in the transistor $T_p$. For each individual pulse $I_{c1}$, $I_{c2}$, $I_{c3}$ and $I_{c4}$, the capacitor C of the resonant circuit CP is charged, and discharged through the primary winding P of the transformer. In the secondary winding S of the transformer, an ignition pulse sequence of the individual ignition pulses $I_{z1}$, $I_{z2}$, $I_{z3}$ and $I_{z4}$ is thereby induced, according to the waveform shown in FIG. 4. If the switches $I_1$ to $I_n$ are open, the ignition pulse sequence is fed to the individual spark plugs $Z_1$ to $Z_n$. The opening of the switches $I_1$ to $I_n$, which is accomplished, for instance, by the transistors in the embodiment example shown, is triggered by non-illustrated sensors, which are disposed at suitable points along the shaft of the distributor rotor of an ignition distributor, and drive the switches $I_1$ to $I_n$ in the rhythm of the firing pulse sequence.

Figure 2:
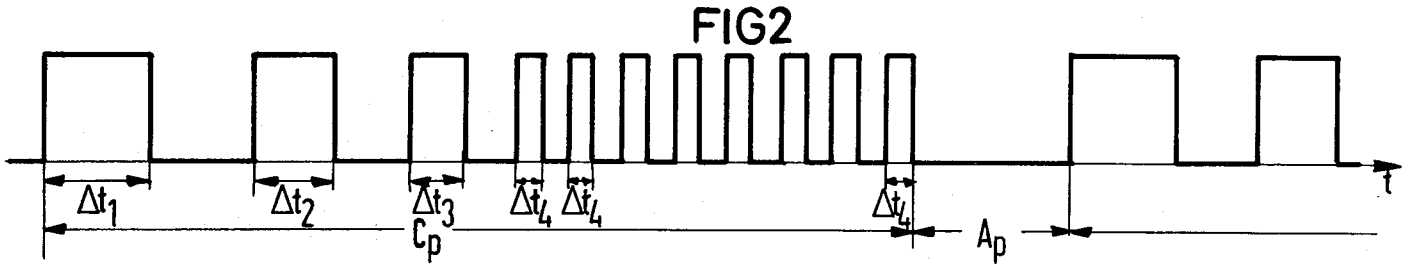
FIGS. 2 to 4 are graphs showing the principle of the ignition system according to the invention, by means of the pulse waveform of the control and ignition pulses.
Figure 3:
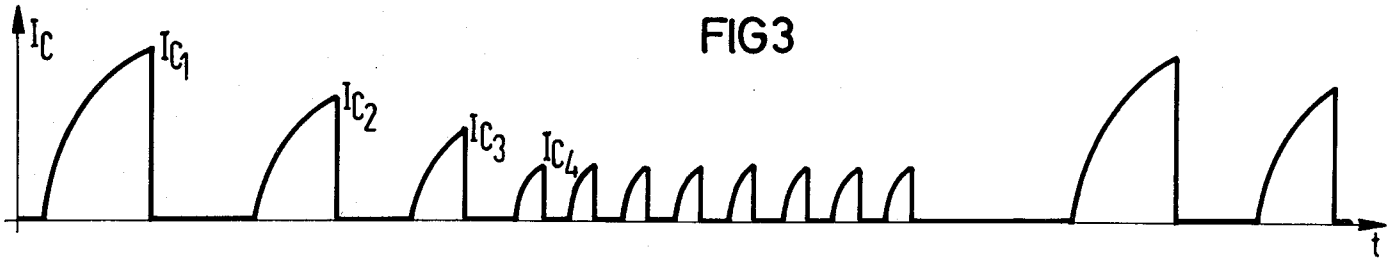
Figure 4:
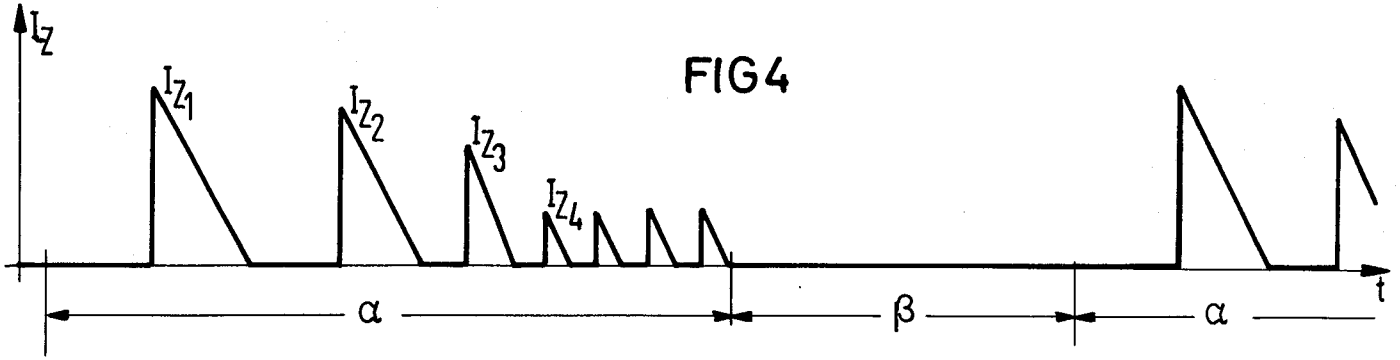

As may be seen from FIGS. 2 to 4, the pulse duration or energy of the first individual pulses is chosen longer than the pulse duration or energy of the remaining individual pulses of a pulse sequence. The pulse duration, especially of the first individual pulse according to FIG.

2, and therefore the energy of the corresponding individual firing pulse $I_{z1}$ (see FIG. 4) are chosen in such a way that the fuel/air mixture is ignited reliably even under the worst conditions. Since the mixture has already been ignited by the first individual firing pulse, a successively smaller amount of energy is sufficient for the second and following individual firing pulses. The required amount of energy finally drops to a constant value to maintain the combustion. Depending on the requirements, the pulse sequence and each individual pulse can be modulated, of course, by the electronic control circuit in any desired manner with respect to duration and frequency and each switch $I_1$ to $I_n$ of each auxiliary winding can be controlled as desired, i.e., opened or closed.

The diode D acts as a surge protector which breaks up interfering voltage peaks that may occur at the primary winding P. The function of the resistor $R_9$ will be explained in greater detail, referring to the circuit diagram according to FIG. 8. At this point in the discussion it need only be mentioned that the voltage caused by the emitter current $I_c$ at the terminals of the resistor $R_9$ is fed back to the electronic control circuit, and the blocking or conduction of the transistor $T_p$ is initiated.

Figure 5:
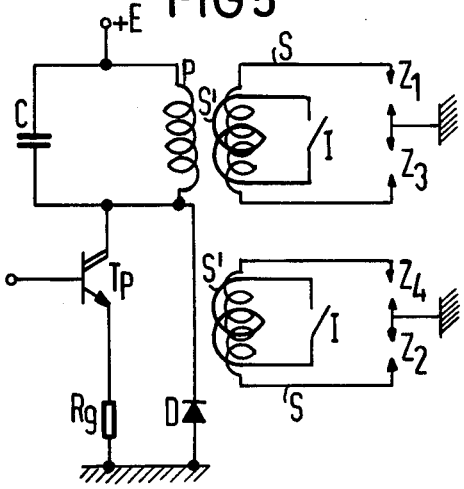
FIGS. 5 to 7 are circuit diagrams of further embodiments for ignition systems addressed in accordance with the invention.
Figure 6:
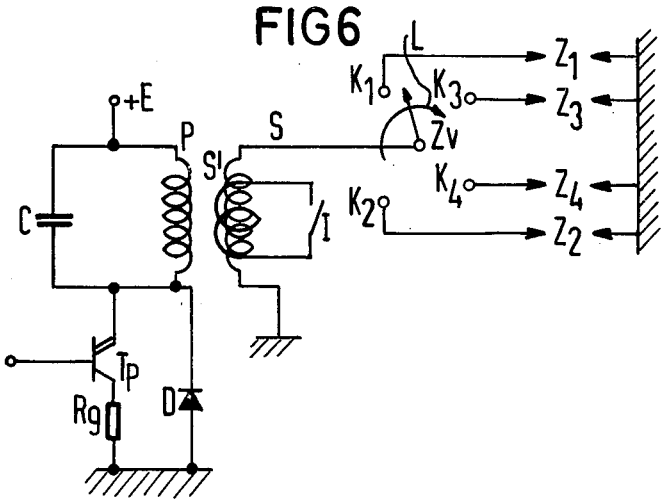

With an otherwise identical drive for the transistor $T_p$ and control of the switches I of the auxiliary windings S', the ignition systems according to FIGS. 5 and 6 differ only with respect to the secondary side of the transformer, from the ignition system according to FIG. 1, Like elements are therefore provided with the same reference symbols, and a repetition of the description of the control and ignition cycles can be dispensed with.

On each of the secondary sides of the transformer, the ignition system according to FIG. 5 has two series-connected spark plugs $Z_1$, $Z_3$ and $Z_4$, $Z_2$ respectively, and a second winding S which is likewise connected in series with the spark plugs and is inductively coupled to an auxiliary winding S'. Ignition systems of this type are used for 4-cylinder gasoline engines.

The ignition system according to FIG. 6 contains a transformer with a single secondary winding S which is inductively coupled to an auxiliary winding S' equipped with a switch I. The secondary winding S is connected to the distributor rotor L of an ignition distributor Zv which rotates in the direction of the arrow, so that the high voltage present at the secondary winding S if the switch is open, sequentially travels through contacts $K_1$ to $K_4$ to the spark plugs $Z_1$ to $Z_4$ in the firing sequence $Z_1$, $Z_3$, $Z_4$ and $Z_2$. The beginning and the end of the ignition are chosen accordingly, so as to ensure an ignition voltage which is as uniform as possible.

Figure 7:
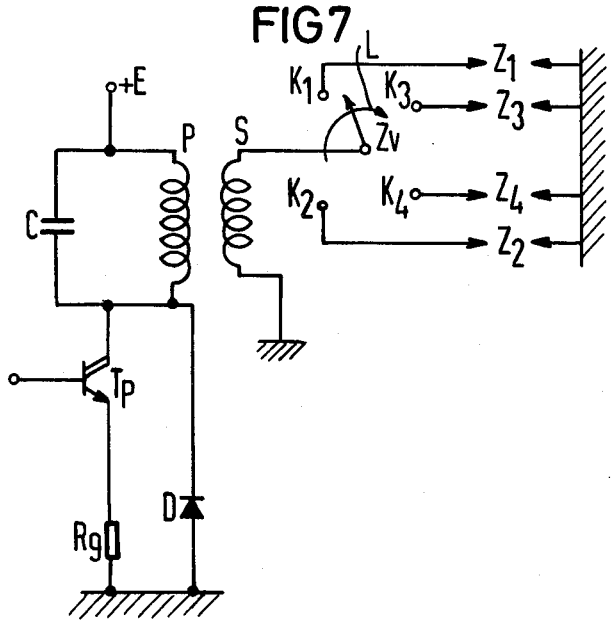

The construction of the ignition system according to FIG. 7 is identical to the ignition system according to FIG. 6 except for the missing auxiliary winding, for which reason like reference symbols are used in FIGS. 6 and 7 for like components. However, contrary to the previous embodiment examples, the duration of each firing pulse sequence is not controlled by corresponding connection and disconnection of the auxiliary winding S', but is determined solely by the driving time $C_p$ of the transistor $T_p$ which is fixed by a flipflop M of an electronic control circuit shown in FIG. 8. This means that during the entire time $A_p$ between two pulse sequences, no firing signals arrive at the spark plug electrodes.

FIG. 8 shows the circuit diagram of a possible electronic control circuit for an ignition system of the type discussed above, the operation of which will be explained as follows:

If the engine is standing still, the OT (upper dead center) transmitter preceding the electronic control circuit according to FIG. 8 delivers no signal. A monostable multivibrator M shown in FIG. 8 is set to "1" with the result that a transistor $T_1$ conducts, a transistor $T_4$ is cut off, a transistor $T_5$ conducts, transistors $T_6$ and $T_7$ are cut off, and as a consequence, the transistor $T_p$ is also cut off.

If the OT transmitter delivers a signal, which is the case with the engine running, the monostable multivibrator M is set to "0" with the provision that the transistor $T_1$ is cut off, a capacitor $C_4$ is charged through an R-C stage $R_1$-$R_2$-$C_1$, the transistor $T_2$ which initially conducts, is gradually cut off while the voltage at the terminals of the capacitor $C_1$ changes, the transistor $T_4$ conducts, the transistor $T_5$ is cut off, the transistors $T_6$ and $T_7$ conduct, and finally the transistor $T_p$ also conducts.

Consequently, a current $I_c$ flows in the resistor $R_9$, because of which the voltage at the terminals of the resistor increases in sawtooth fashion until it has reached the threshold at which the transistor $T_3$ conducts again. In this way, a negatively extending voltage flank is transmitted to the base of the transistor $T_4$, so that the latter is cut off, the transistor $T_5$ conducts, the transistors $T_6$ and $T_7$ are cut off and therefore, the transistor $T_p$ is also cut off again; i.e., the current $I_c$ through transistor $T_p$ is equal to zero. The capacitor $C_2$ is charged through a resistor $R_6$ and the collector-emitter path of the transistor $T_5$, and this switches the transistor $T_4$ on through the diode $D_1$ after a period $\tau(\tau \simeq C_2 \times R_6)$. As a result, the transistor $T_5$ is cut off, the transistors $T_6$ and $T_7$ conduct, and therefore the transistor $T_p$ also conducts again. The potential at the resistor $R_9$ rises again and reaches the response threshold of the transistor $T_3$, so that the latter conducts, transistor $T_4$ is cut off, the transistor $T_5$ conducts, the transistors $T_6$ and $T_7$ conduct, and thus the transistor $T_p$ is also cut off.

This cycle described above, is repeated as long as the monostable multivibrator M is reset to "1". In this case, the transistor $T_3$ is first cut off in accordance with the charging voltage at the capacitor $C_4$, from which a corresponding impedance $R_6+R$ (collector-emitter of $T_2$) parallel to the resistor $R_4$ is obtained. The impedance changes in accordance with the time constant $R_1$-$R_2$-$C_1$. Due to the collector-emitter impedance of the transistor $T_2$, which changes in accordance with the voltage applied to the base of this transistor, the collector current of the transistor $T_3$ also changes. This results in a variable response threshold of the transistor $T_4$, which can extend the conduction period of this transistor. In this way a longer conduction period for the transistor $T_p$ and a correspondingly larger collector current $I_c$ in the transistor $T_p$ is obtained. This is possible as long as the capacitor $C_1$ has not reached its maximum charge; i.e., as long as the capacitor $C_1$ is being charged, the collector current of the transistor $T_p$ is larger due to the longer conduction period of this transistor. When the capacitor $C_1$ has reached its maximum charge, then the transistor $T_2$ and the collector current in the transistor $T_3$ is limited by the resistors $R_4$ and $R_5$. The response threshold of the transistor $T_4$ is consequently reached more quickly; this results in a shorter conduction period of the transistor $T_4$ and finally, in a shorter conductance period of the transistor $T_p$, and less collector current in the transistor $T_p$.

It is therefore possible, through appropriate adjustment of the R-C stage $R_1$-$R_2$-$C_1$, to choose the number of individual pulses addressing the transistor $T_p$ on the secondary side of the transformer, which have a pulse duration leading to ignition pulses with maximum energy.

The foregoing is a description corresponding to French Application 81 14 259, dated July 22, 1981, International priority of which is being claimed for the instant application, and which is hereby made part of this application. Any discrepancies between the foregoing specification and the aforementioned corresponding French application are to be resolved in favor of the latter.

There are claimed:

1. Ignition system for internal combustion engines, comprising a transformer having a primary side with a primary winding and a secondary side with at least one secondary winding, a chopper connected to said primary winding for addressing said primary winding, a d-c or rectified a-c voltage source connected to said chopper, said at least one secondary winding being selectively coupled to spark plugs of the internal combustion engine, and electronic control means connected to said chopper for driving said chopper with pulse sequences having individual width-modulated pulses and for supplying the spark plugs with ignition pulse sequences having corresponding individual ignition pulses with modulated energy.

2. Ignition system according to claim 1, wherein said individual pulses of said pulse sequences driving said chopper include at least one initial individual pulse having a relatively longer duration and remaining pulses having a relatively shorter duration, for giving said corresponding individual ignition pulses sufficient energy to ignite a fuel and air mixture under any conditions.

3. Ignition system according to claim 2, wherein the duration of said at least one initial individual pulse of said pulse sequences fed to said chopper is modulated, for causing said corresponding individual ignition pulse to ignite the fuel and air mixture under any conditions.

4. Ignition system according to claim 3, wherein the duration of said individual pulses of each of said pulse sequences decreases toward a constant value in said sequence.

5. Ignition system according to claim 1, wherein said electronic control means are in the form of an electronic control circuit connected to said chopper for generating and modulating said pulse sequences fed to said chopper.

6. Ignition system according to claim 1, wherein said chopper includes a transistor having a base being connected to said electronic control means and an emitter and a collector defining an emitter-collector path connected in series with said primary winding, said series connection of said primary winding and emitter-collector path of said transistor being connected to said voltage source.

7. Ignition system according to claim 1, wherein said at least one secondary winding includes a separate secondary winding respectively coupled to each spark plug, an auxiliary winding being respectively inductively coupled to each of said secondary windings and being wound in the opposite sense relative to said secondary windings, said chopper being driven with constant pulse sequences having individual pulses with modulated duration, and a circuit having switch means connected to said auxiliary windings for short circuiting and opening said circuit in a firing sequence rhythm.

8. Ignition system according to claim 1, wherein said at least one secondary winding includes a separate secondary winding respectively connected in series with each two spark plugs, an auxiliary winding being respectively inductively coupled to each of said secondary windings and being wound in the opposite sense relative to said secondary windings, said chopper being driven with constant pulse sequences having individual pulses with modulated duration, and a circuit having switch means connected to said auxiliary windings for short circuiting and opening said circuit in a firing sequence rhythm.

9. Ignition system according to claim 1, wherein said at least one secondary winding is in the form of a single secondary winding, and including an auxiliary winding being inductively coupled to said secondary winding and being wound in the opposite sense relative to said secondary winding, an openable circuit connected to said auxiliary winding, said chopper being controlled by constant pulse sequences having individual pulses with modulated duration, and a distributor connecting said secondary winding to the spark plugs in a firing sequence rhythm with said circuit open.

10. Ignition system according to claim 1, wherein said electronic control means includes a monostable multivibrator stage, and said at least one secondary winding is in the form of a single secondary winding, and including a distributor connecting said secondary winding to the spark plugs in a firing sequence rhythm, said chopper being supplied with pulse sequences having modulated individual pulses with a duration being determined by said monostable multivibrator stage.

* * * * *